US005250237A

United States Patent [19]

Shin

[11] Patent Number: 5,250,237

[45] Date of Patent: Oct. 5, 1993

[54] ALCOHOL-BASED SPIN LIQUIDS FOR FLASH-SPINNING POLYMERIC PLEXIFILAMENTS

[75] Inventor: Hyunkook Shin, Wilmington, Del.

[73] Assignee: E. I. Du Pont de Nemours and Company, Wilmington, Del.

[21] Appl. No.: 881,032

[22] Filed: May 11, 1992

[51] Int. Cl.[5] ..... D01D 5/11

[52] U.S. Cl. ..... 264/13; 264/205; 264/211; 264/211.14

[58] Field of Search ..... 264/13, 205, 211, 211.14, 264/517, 518

[56] References Cited

U.S. PATENT DOCUMENTS

| | | | |
|---|---|---|---|
| 3,081,519 | 3/1963 | Blades et al. | 57/248 |
| 3,227,784 | 1/1966 | Blades et al. | 264/53 |
| 3,227,794 | 1/1966 | Anderson et al. | 264/205 |
| 4,554,207 | 11/1985 | Lee | 428/288 |
| 5,032,326 | 7/1991 | Shin | 264/13 |
| 5,043,108 | 8/1991 | Samuels | 264/13 |
| 5,147,586 | 9/1992 | Shin et al. | 264/13 |

FOREIGN PATENT DOCUMENTS

| | | |
|---|---|---|
| 891943 | 3/1962 | United Kingdom . |
| 891945 | 3/1962 | United Kingdom . |

OTHER PUBLICATIONS

P. S. Zurer, "Search Intensifies for Alternatives to Ozone-Depleting Halo-Carbons" Chemical & Engineering News, pp. 17-20 (Feb. 8, 1988).

Allowed Application U.S. Ser. No. 07/660,768 (filed Feb. 22, 1991) Shin et al.

*Primary Examiner*—Leo B. Tentoni

[57] ABSTRACT

A process is provided for flash-spinning plexifilamentary film-fibril strands of a fiber-forming polyolefin from a $C_{1-4}$ alcohol or a $C_{1-4}$ alcohol/co-solvent spin liquid that, if released to the atmosphere, presents no or a greatly reduced ozone depletion hazard, as compared to the halocarbon spin liquids currently-used commercially for making such strands. The resulting flash-spun plexifilamentary film-fibril strands are well fibrillated and are of a quality equivalent to commercially available strands. The invention also covers the spin liquids useful in the inventive process.

14 Claims, 6 Drawing Sheets

6000
5000
4000
3000
2000
1000
0
CLOUD POINT PRESSURE (psig)
50/50
60/40
70/30
40/60
140
160
180
200
220
240
260
280
300
TEMPERATURE (°C)

ALCOHOL-BASED SPIN LIQUIDS FOR FLASH-SPINNING POLYMERIC PLEXIFILAMENTS

FIELD OF THE INVENTION

The invention generally relates to flash-spinning polymeric film-fibril strands. More particularly, the invention concerns an improvement in such a process which permits flash-spinning of the strands from $C_{1-4}$ alcohol-based spin liquids which, if released to the atmosphere, would not detrimentally affect the earth's ozone layer.

BACKGROUND OF THE INVENTION

U.S. Pat. No. 3,081,519 (Blades et al.) describes a flash-spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash-spinning causes the liquid to vaporize and thereby cool the exudate which forms a plexifilamentary film-fibril strand of the polymer. Preferred polymers include crystalline polyhydrocarbons such as polyethylene and polypropylene.

According to Blades et al., in both U.S. Pat. No. 3,081,519 and U.S. Pat. No. 3,227,784, a suitable liquid for the flash spinning desirably (a) has a boiling point that is at least 25 C. below the melting point of the polymer; (b) is substantially unreactive with the polymer at the extrusion temperature; (c) should be a solvent for the polymer under the pressure and temperature set forth in the patent (i.e., these extrusion temperatures and pressures are respectively in the ranges of 165 to 225 C. and 545 to 1490 psia); (d) should dissolve less than 1% of the polymer at or below its normal boiling point; and should form a solution that will undergo rapid phase separation upon extrusion to form a polymer phase that contains insufficient solvent to plasticize the polymer. Depending on the particular polymer employed, the following liquids are useful in the flash-spinning process: aromatic hydrocarbons such as benzene, toluene, etc.; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as trichlorofluoromethane, methylene chloride, carbon tetrachloride, chloroform, ethyl chloride, methyl chloride; alcohols; esters; ethers; ketones; nitriles; amides; fluorocarbons; sulfur dioxide; carbon disulfide; nitromethane; water; and mixtures of the above liquids. The patents illustrate certain principles helpful in establishing optimum spinning conditions to obtain plexifilamentary strands. Blades et al. state that the flash-spinning solution additionally may contain a dissolved gas, such as nitrogen, carbon dioxide, helium, hydrogen, methane, propane, butane, ethylene, propylene, or butene, to assist nucleation by increasing the "internal pressure" and lowering the surface tension of the solution. Preferred for improving plexifilamentary fibrillation are the less soluble gases, i.e., those that are dissolved to a less than 7% concentration in the polymer solution under the spinning conditions. Common additives, such as antioxidants, UV stabilizers, dyes, pigments and the like also can be added to the solution prior to extrusion.

U.S Pat. 3,227,794 (Anderson et al.) discloses a diagram similar to that of Blades et al. for selecting conditions for spinning plexifilamentary strands. A graph is presented of spinning temperature versus cloud-point pressure for solutions of 10 to 16 weight percent of linear polyethylene in trichlorofluoromethane. Anderson et al. describe in detail the preparation of a solution of 14 weight percent high density linear polyethylene in trichlorofluoromethane at a temperature of about 185 C. and a pressure of about 1640 psig which is then flash-spun from a let-down chamber at a spin temperature of 185 C. and a spin pressure of 1050 psig. Very similar temperatures, pressures and concentrations have been employed in commercial flash-spinning of polyethylene into plexifilamentary film-fibril strands, which were then converted into sheet structures.

Although trichlorofluoromethane has been a very useful solvent for flash-spinning plexifilamentary film-fibril strands of polyethylene, and has been the dominant solvent used in commercial manufacture of polyethylene plexifilamentary strands, the escape of such a halocarbon into the atmosphere has been implicated as a source of depletion of the earth's ozone layer. A general discussion of the ozone-depletion problem is presented, for example, by P. S. Zurer, "Search Intensifies for Alternatives to Ozone-Depleting Halocarbons", *Chemical & Engineering News.* pages 17–20 (Feb. 8, 1988).

Clearly, what is needed is a flash-spinning process which uses a spin liquid which does not have the deficiencies inherent in the prior art. It is therefore an object of this invention to provide an improved process for flash-spinning plexifilamentary film-fibril strands of a fiber-forming polymer, wherein the spin liquid used for flash-spinning is not a depletion hazard to the earth's ozone layer. Other objects and advantages of the present invention will become apparent to those skilled in the art upon reference to the detailed description of the invention which hereinafter follows.

SUMMARY OF THE INVENTION

In accordance with the invention, there is provided a process for flash-spinning plexifilamentary film-fibril strands of a fiber-forming polyolefin. Preferably, the polyolefin is selected from the group consisting of polyethylene, polypropylene and polymethylpentene.

In one embodiment, the invention comprises a process for flash-spinning plexifilamentary film-fibril strands wherein a polyolefin is dissolved in a spin liquid to form a spin mixture containing 1 to 35 percent of polyolefin by weight of the spin mixture at a temperature in the range of 130 to 300 C. and a mixing pressure that is greater than the autogeneous pressure of the spin mixture, preferably greater than the cloud point pressure of the spin mixture, which spin mixture is flash-spun into a region of substantially lower temperature and pressure. The improvement comprises the spin liquid comprising an alcohol spin liquid containing from 1 to 4 carbon atoms. Preferably, the $C_{1-4}$ alcohol spin liquid is selected from the group consisting of methanol, ethanol, 1-propanol, 2-propanol, tertiary butanol and mixtures thereof.

In a preferred mode of the first embodiment, the invention comprises a process for flash-spinning plexifilamentary film-fibril strands wherein polyethylene is dissolved in a spin liquid to form a spin mixture containing 1 to 35 percent of polyethylene by weight of the spin mixture at a temperature in the range of 130 to 300 C. and a mixing pressure that is greater than the autogeneous pressure of the spin mixture, preferably greater than the cloud-point pressure of the spin mixture, which spin mixture is flash-spun into a region of substantially lower temperature and pressure. The improvement comprises the spin liquid being selected from the group consisting of 1-propanol, 2-propanol and mixtures thereof.

In another preferred mode of the first embodiment, the invention comprises a process for flash-spinning plexifilamentary film-fibril strands wherein polypropylene is dissolved in a spin liquid to form a spin mixture containing 1 to 35 percent of polypropylene by weight of the spin mixture at a temperature in the range of 130 to 300 C. and a mixing pressure that is greater than the autogeneous pressure of the spin mixture, preferably greater than the cloud-point pressure of the spin mixture, which spin mixture is flash-spun into a region of substantially lower temperature and pressure. The improvement comprises the spin liquid being selected from the group consisting of ethanol, 1-propanol, 2-propanol and mixtures thereof.

In another embodiment, the invention comprises a process for flash-spinning plexifilamentary film-fibril strands wherein a polyolefin is dissolved in a spin liquid to form a spin mixture containing 1 to 35 percent of polyolefin by weight of the spin mixture at a temperature in the range of 130 to 300 C. and a mixing pressure that is greater than the autogeneous pressure of the spin mixture, preferably greater than the cloud-point pressure of the spin mixture, which spin mixture is flash-spun into a region of substantially lower temperature and pressure. The improvement comprises the spin liquid comprising an alcohol/co-solvent spin liquid wherein the alcohol contains from 1 to 4 carbon atoms and the co-solvent is capable of lowering the cloud-point pressure of the resulting spin mixture by at least 200 psig at the polyolefin concentration and the spin temperature used for flash-spinning. The co-solvent is a strong solvent for the polyolefin and is present in an amount up to 50 percent by weight of the total alcohol/co-solvent spin liquid present. Preferably, the $C_{1-4}$ alcohol spin liquid is selected from the group consisting of methanol, ethanol, 1-propanol, 2-propanol, tertiary butanol and mixtures thereof while the co-solvent comprises a hydrocarbon having from 4 to 7 carbon atoms. Preferably, the hydrocarbon co-solvent is selected from the group consisting of butane, pentane, hexane, cyclobutane, cyclopentane, cyclohexane, their isomers and mixtures thereof.

In yet another embodiment, the invention comprises a process for flash-spinning plexifilamentary film-fibril strands wherein a polyolefin is dissolved in a spin liquid to form a spin mixture containing 1 to 35 percent of polyolefin by weight of the spin mixture at a temperature in the range of 130 to 300 C. and a mixing pressure that is greater than the autogeneous pressure of the spin mixture, preferably greater than the cloud-point pressure of the spin mixture, which spin mixture is flash-spun into a region of substantially lower temperature and pressure. The improvement comprises the spin liquid comprising an alcohol/co-solvent spin liquid wherein the alcohol contains from 1 to 4 carbon atoms and the co-solvent is capable of raising the cloud-point pressure of the resulting spin mixture by at least 200 psig at the polyolefin concentration and the spin temperature used for flash-spinning. The co-solvent is a non-solvent for the polyolefin and is present in an amount up to 50 percent by weight of the total alcohol/co-solvent spin liquid present. Preferably, the $C_{1-4}$ alcohol spin liquid is selected from the group consisting of methanol, ethanol, 1-propanol, 2-propanol, tertiary butanol and mixtures thereof. Preferably, the co-solvent spin liquid is selected from the group consisting of inert gases such as nitrogen and carbon dioxide; water; polar solvents such as ketones and ethers; perfluorinated hydrocarbons; hydrofluorocarbons (HFC's); hydrochlorofluorocarbons (HCFC's); and mixtures thereof.

The invention also provides a novel flash-spinning spin mixture for forming plexifilamentary film-fibril strands comprising 1 to 35 weight percent of a fiber-forming polyolefin, preferably polyethylene, polypropylene or polymethylpentene, and 65 to 99 weight percent of a spin liquid, the spin liquid comprising an alcohol spin liquid selected from the group consisting of methanol, ethanol, 1-propanol, 2-propanol, tertiary butanol and mixtures thereof.

In another embodiment the invention provides a novel flash-spinning spin mixture for forming plexifilamentary film-fibril strands comprising 1 to 35 weight percent of a fiber-forming polyolefin, preferably polyethylene, polypropylene or polymethylpentene, and 65 to 99 weight percent of a spin liquid, the spin liquid comprising no less than 50 weight percent of an alcohol spin liquid selected from the group consisting of methanol, ethanol, 1-propanol, 2-propanol, tertiary butanol and mixtures thereof, and no more than 50 weight percent of a co-solvent spin liquid comprising a hydrocarbon containing from 4 to 7 carbon atoms. Preferably, the hydrocarbon is selected from the group consisting of butane, pentane, hexane, cyclobutane, cyclopentane, cyclohexane, their isomers and mixtures thereof.

In yet another embodiment, the invention provides a novel flash-spinning spin mixture for forming plexifilamentary film-fibril strands comprising 1 to 35 weight percent of a fiber-forming polyolefin, preferably polyethylene, polypropylene or polymethylpentene, and 65 to 99 weight percent of a spin liquid, the spin liquid comprising no less than 50 weight percent of an alcohol spin liquid selected from the group consisting of methanol, ethanol, 1-propanol, 2-propanol, tertiary butanol and mixtures thereof, and no more than 50 weight percent of a co-solvent spin liquid selected from the group consisting of inert gases such as nitrogen and carbon dioxide; water; polar solvents such as ketones and ethers; perfluorinated hydrocarbons; hydroflurocarbons (HFC's); hydrochlorofluorocarbons (HCFC's); and mixtures thereof.

BRIEF DESCRIPTION OF THE DRAWINGS

The following figures are provided to illustrate the cloud-point pressures curves of selected spin mixtures at varying spin liquid concentrations and spin temperatures.

DETAILED DESCRIPTION OF THE PREFERRED EMBODIMENTS

Figure 1:
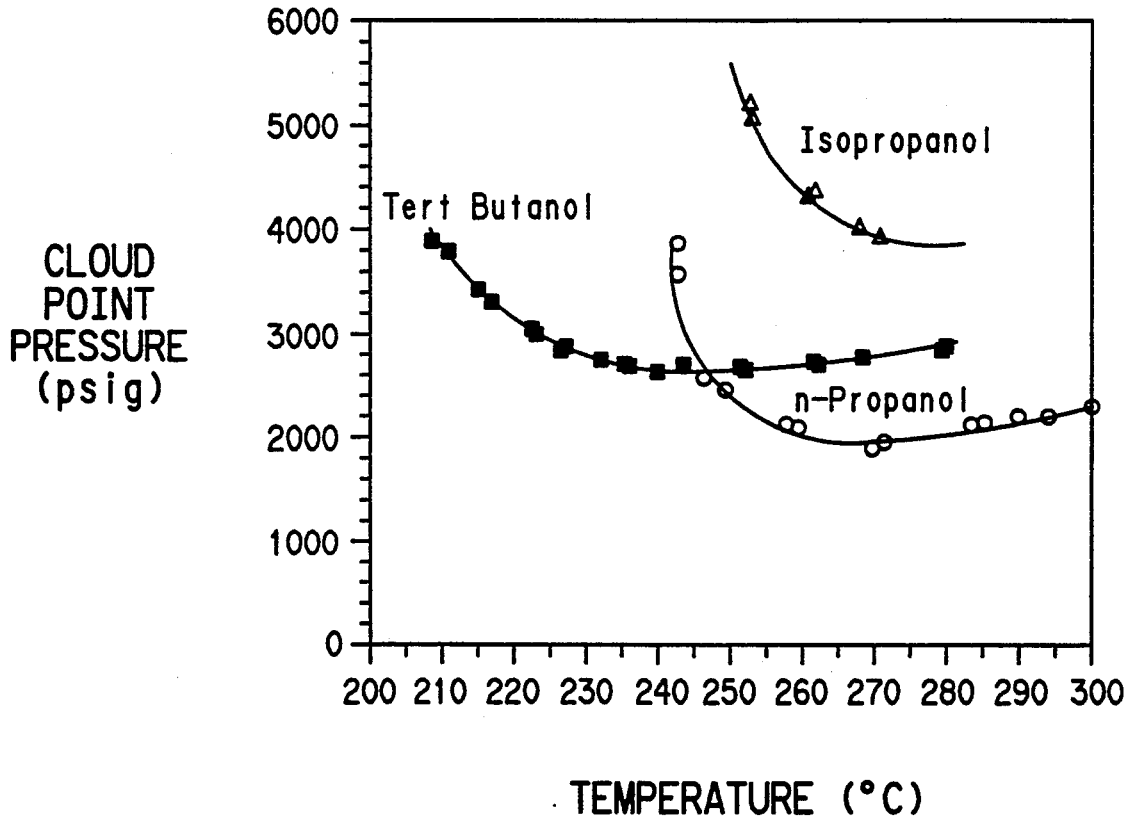
FIG. 1 is a cloud-point pressure curve for 30 weight percent high density polyethylene in various 100 wt. % alcohol spin liquids.

The term "polyolefin" as used herein, is intended to mean any of a series of largely saturated open chain polymeric hydrocarbons composed only of carbon and hydrogen. Typical polyolefins include, but are not limited to, polyethylene, polypropylene, and polymethylpentene. Conveniently, polyethylene and polypropylene are the preferred polyolefins for use in the process of the present invention.

"Ethanol" as used herein is intended to mean not only pure ethanol but also denatured ethanol (e.g., ethyl alcohol containing small amounts of methanol, benzene, toluene, etc.). It will be understood that there are many different types of denatured ethanol. One of the most common types is "2-B alcohol", which contains one-half gallon of benzene or one-half gallon of rubber hydrocarbon solvent per 100 gallons of ethyl alcohol.

"Polyethylene" as used herein is intended to embrace not only homopolymers of ethylene, but also copolymers wherein at least 85% of the recurring units are ethylene units. One preferred polyethylene is a linear high density polyethylene which has an upper limit of melting range of about 130 to 135 C., a density in the range of 0.94 to 0.98 g/cm$^3$ and a melt index (as defined by ASTM D-1238-57T, Condition E) of between 0.1 to 100, preferably less than 4.

The term "polypropylene" is intended to embrace not only homopolymers of propylene but also copolymers wherein at least 85% of the recurring units are propylene units.

The term "plexifilamentary film-fibril strands" as used herein, means a strand which is characterized as a three-dimensional integral network of a multitude of thin, ribbon-like, film-fibril elements of random length and of less than about 4 microns average thickness, generally coextensively aligned with the longitudinal axis of the strand. The film-fibril elements intermittently unite and separate at irregular intervals in various places throughout the length, width and thickness of the strand to form the three-dimensional network. Such strands are described in further detail in U.S. Pat. No. 3,081,519 (Blades et al.) and in U.S. Pat. No. 3,227,794 (Anderson et al.), the contents of which are incorporated herein.

The term "cloud-point pressure" as used herein, means the pressure at which a single phase liquid solution starts to phase separate into a polyolefin-rich/spin liquid-rich two phase liquid dispersion.

The term "co-solvent spin liquid" as used herein, means a miscible spin liquid that is added to an alcohol spin liquid containing a dissolved polyolefin to either raise or lower the cloud-point pressure of the resulting spin mixture (i.e., the co-solvent, alcohol spin liquid and polyolefin) by 200 psig, preferably by 500 psig or even more, at the polyolefin concentration and the spin temperature used for flash-spinning.

To raise the cloud-point pressure the co-solvent spin liquid must be a "non-solvent" for the polyolefin, or at least a poorer solvent than the alcohol spin liquid. (In other words, the solvent power of the co-solvent spin liquid used must be such that if the polyolefin to be flash-spun were to be dissolved in the co-solvent spin liquid alone, the polyolefin would not dissolve in the co-solvent spin liquid, or the resultant solution would have a cloud-point pressure greater than about 7000 psig). Preferably, in this application the co-solvent spin liquid is an inert gas such as carbon dioxide or nitrogen; water; a polar solvent such as a ketone or an ether; a perfluorinated hydrocarbon; a hydrofluorocarbon (HFC); a hydrochlorofluorocarbon (HCFC); and mixtures thereof. The co-solvent spin liquid must be present in an amount no greater than 50 weight percent of the total weight of the co-solvent spin liquid and the alcohol spin liquid. It will be understood that the co-solvent spin liquid can be made up of one co-solvent or mixtures of co-solvents.

To lower the cloud-point pressure the co-solvent spin liquid must be a "strong solvent" for the polyolefin, or at least a better solvent than the alcohol spin liquid. (In other words, the solvent power of the co-solvent spin liquid used must be such that if the polyolefin to be flash-spun were to be dissolved in the co-solvent spin liquid alone, the polyolefin would easily dissolve in the co-solvent spin liquid, or the resultant solution would have a lower cloud-point pressure than it would have without addition of the co-solvent. Preferably, in this application the co-solvent spin liquid is a hydrocarbon having from 4 to 7 carbon atoms (e.g., butane, pentane, hexane, cyclobutane, cyclopentane, cyclohexane, their isomers, and mixtures thereof). The co-solvent spin liquid must be present in an amount no greater than 50 weight percent of the total weight of the co-solvent spin liquid and the alcohol spin liquid. It will be understood that the co-solvent spin liquid can be made up of one co-solvent or mixtures of co-solvents.

The present invention provides an improvement in the known process for producing plexifilamentary film-fibril strands of fiber-forming polyolefins from a spin liquid that contains the fiber-forming polyolefin. In the known processes, which were described in the above-mentioned U.S. patents, a fiber-forming polyolefin, e.g. linear polyethylene, is typically dissolved in a spin liquid that includes a halocarbon to form a spin solution containing about 10 to 20 percent of the linear polyethylene by weight of the solution and then is flash-spun at a temperature in the range of 130 to 230 C. and a pressure that is greater than the autogenous pressure of the spin liquid into a region of substantially lower temperature and pressure.

The key improvement of the present invention requires that the spin liquid comprise a $C_{1-4}$ alcohol or a $C_{1-4}$ alcohol/co-solvent spin liquid that has no or greatly reduced ozone depletion potential. In this invention, well-fibrillated plexifilamentary film-fibril strands can be successfully produced using a $C_{1-4}$ alcohol spin liquid or a $C_{1-4}$ alcohol spin liquid combined with a co-solvent spin liquid. It will be understood that the $C_{1-4}$ alcohol spin liquid can comprise a single $C_{1-4}$ alcohol or mixtures thereof. As noted above, the purpose of adding the co-solvent spin liquid to the $C_{1-4}$ alcohol spin liquid is to either raise or lower the cloud-point pressure of the resulting spin mixture, as the case may be.

Figure 2:
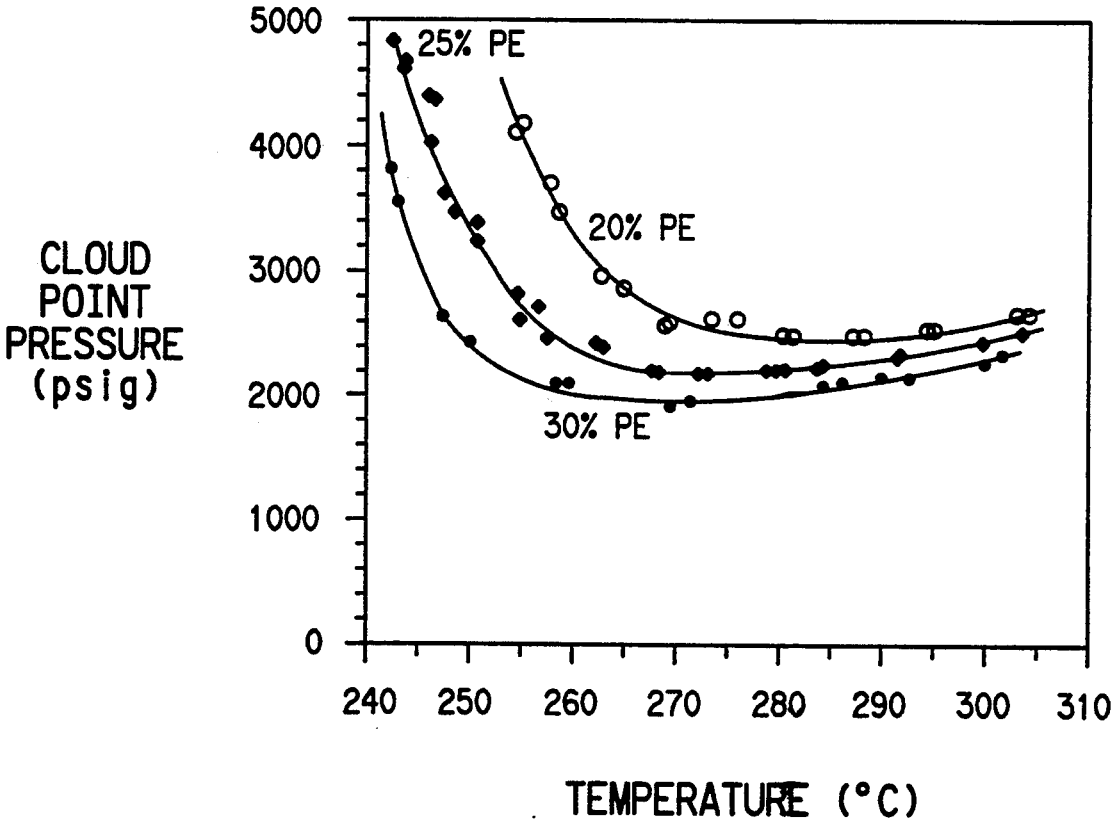
FIG. 2 is a cloud-point pressure curve for various weight percentages of high density polyethylene in a 1-propanol spin liquid.
Figure 3:
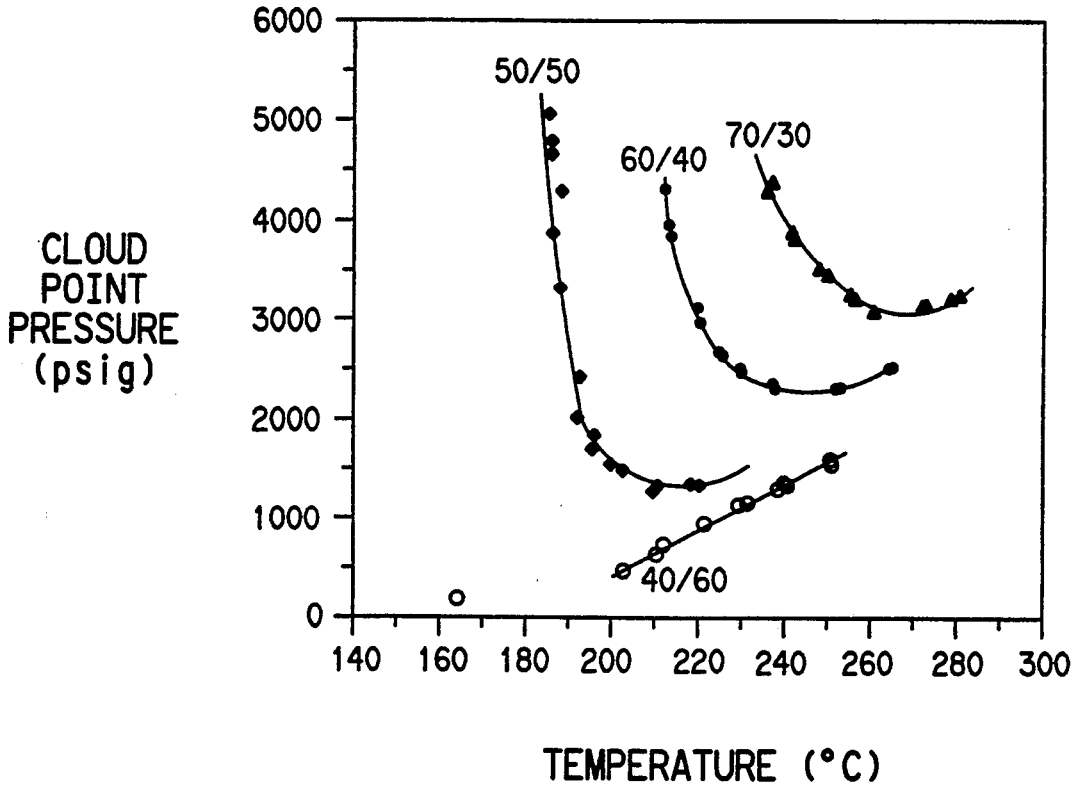
FIG. 3 is a cloud-point pressure curve for 22 weight percent high density polyethylene in various concentrations of an ethanol/cyclohexane spin liquid.
Figure 4:
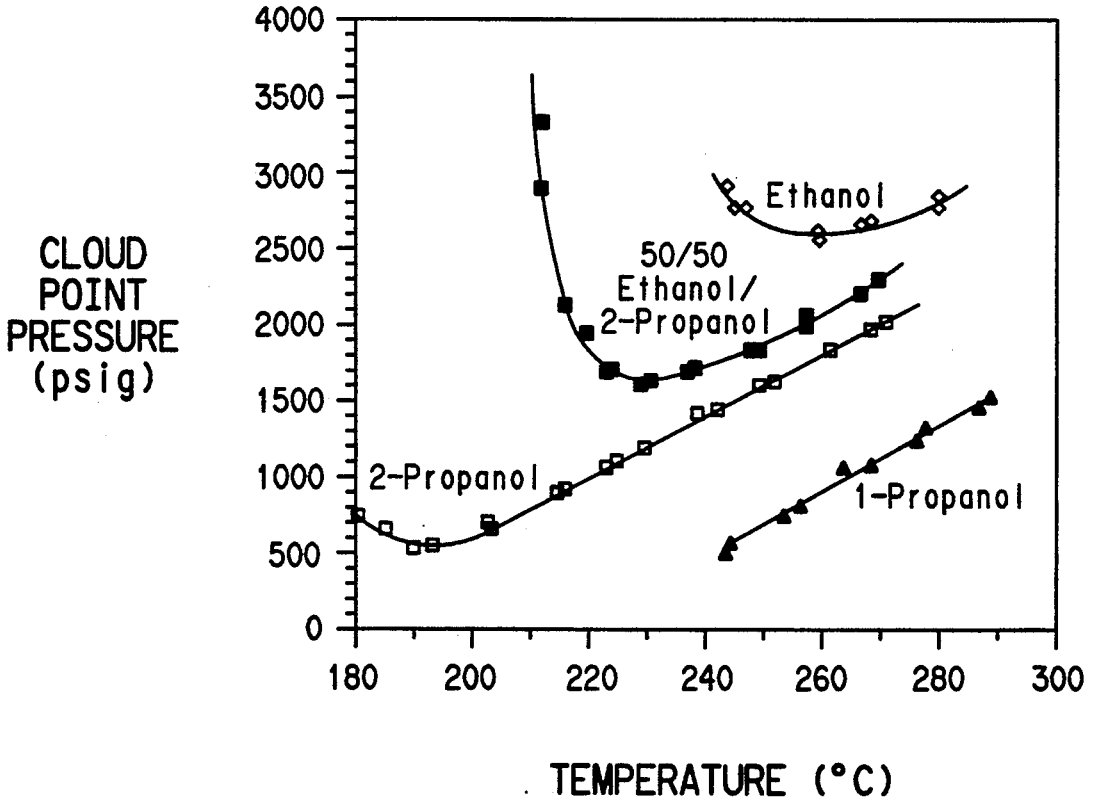
FIG. 4 is a cloud-point pressure curve for 22 weight percent polypropylene in various alcohol spin liquids.
Figure 5:
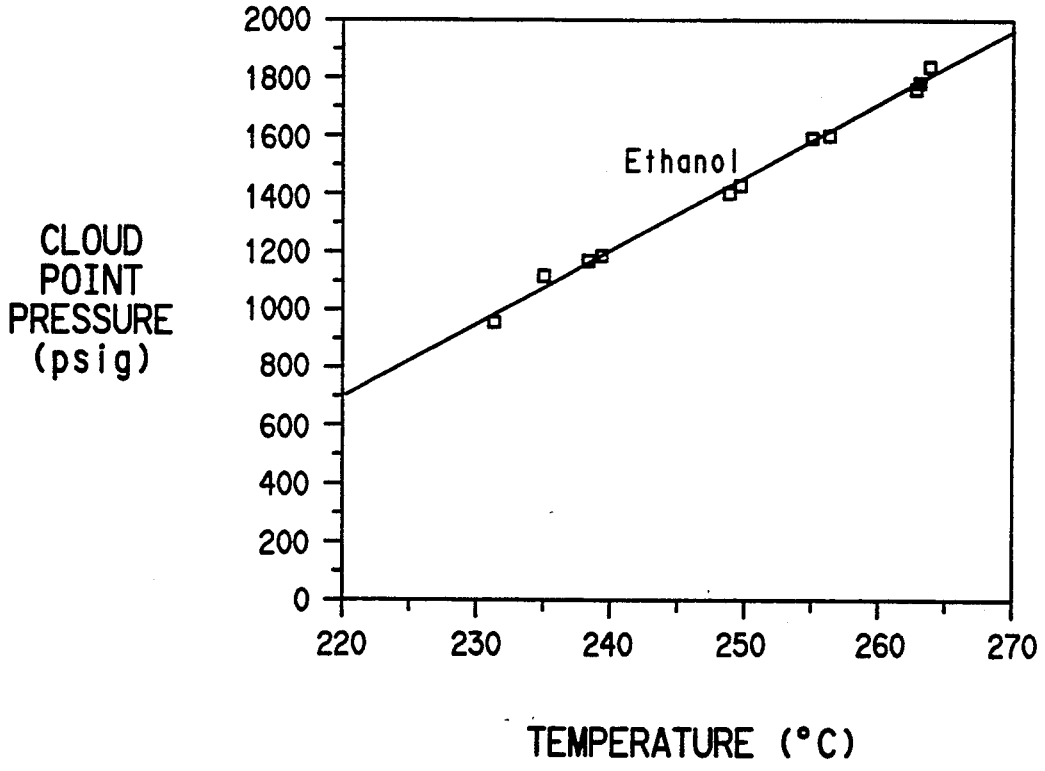
FIG. 5 is a cloud-point pressure curve for 22 weight percent polymethylpentene in an ethanol spin liquid.
Figure 6:
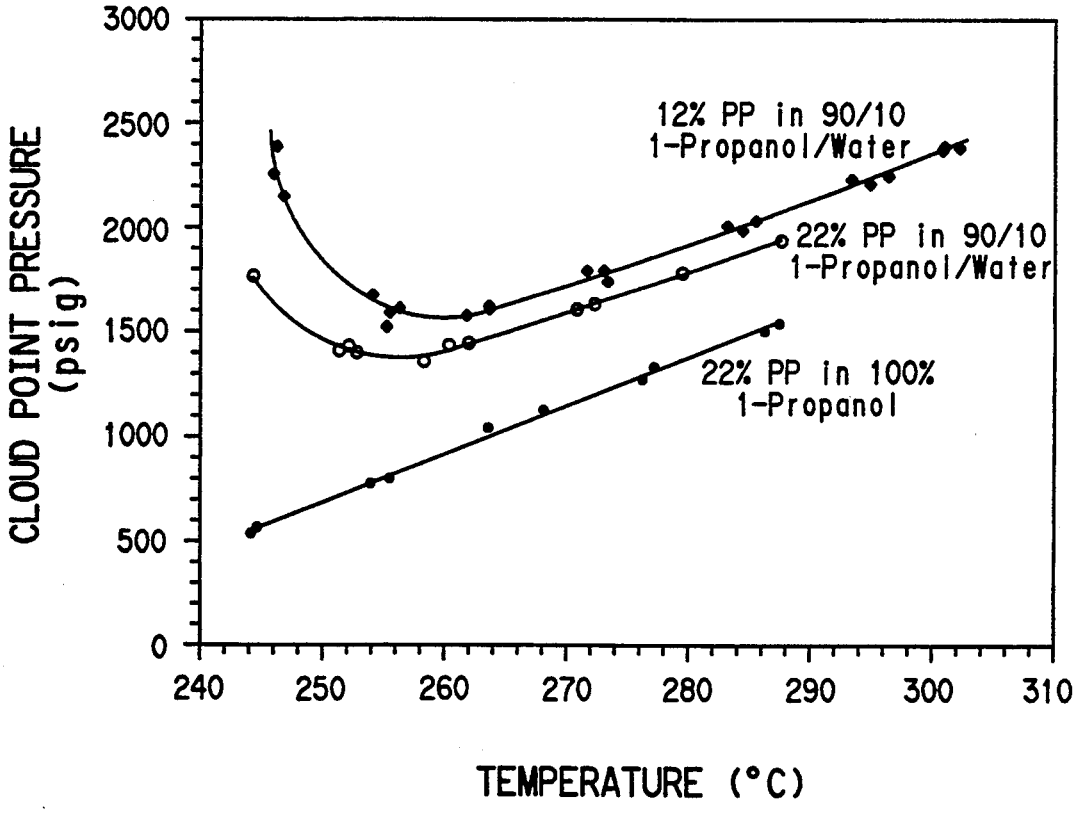
FIG. 6 is a cloud-point pressure curve for various weight percentages of polypropylene in a 90 wt. % 1-propanol/10 wt. % water spin liquid.

FIGS. 1-6 illustrate cloud-point pressure curves for a selected number of 100 wt. % $C_{1-4}$ alcohol spin liquids and a selected number of $C_{1-4}$ alcohol/co-solvent spin liquids in accordance with the invention. The Figures provide the cloud-point pressure for particular spin liquids as a function of spin temperature in degrees C.

The following Table lists the known normal atmospheric boiling point (Tbp), critical temperature (Tcr), critical pressure (Pcr), heat of vaporization (H of V), density (gm/cc) and molecular weights (MW) for CFC-11 and for several selected co-solvents spin liquids and alcohol spin liquids useful in the invention. In the Table, the parenthetic designation is an abbreviation for the chemical formula of certain well known halocarbons (e.g., trichlorofluoromethane=CFC-11).

| | Spin Liquid Properties | | | | | |
|---|---|---|---|---|---|---|
| | Tbp C. | Tcr C. | Pcr psia | H of V cal/gm | Density gm/cc | MW |
| (CFC-11) | 23.80 | 198.0 | 639.5 | 43.3 | 1.480 | 137.368 |
| Isobutane | −11.75 | 135.1 | 529.3 | — | 0.557 | 58.124 |
| Butane | −0.45 | 152.1 | 551.0 | 87.5 | 0.600 | 58.124 |
| Cyclobutane | 12.55 | 186.9 | 723.6 | — | 0.694 | 56.108 |
| 2-methyl butane | 27.85 | 187.3 | 491.6 | — | 0.620 | 72.151 |
| 2,2 dimethyl propane | 9.45 | 160.6 | 464.0 | — | 0.591 | 72.151 |
| Pentane | 36.10 | 196.6 | 488.7 | 91.0 | 0.630 | 72.151 |
| Methyl cyclobutane | 39–42 | — | — | — | 0.693 | 70.135 |
| Cyclopentane | 49.25 | 238.6 | 654.0 | — | 0.745 | 70.135 |
| 2,2-dimethylbutane | 49.65 | 215.7 | 446.6 | — | 0.649 | 86.178 |
| 2,3-dimethylbutane | 57.95 | 226.9 | 453.9 | — | 0.662 | 86.178 |
| 2-methylpentane | 60.25 | 224.4 | 436.5 | — | 0.653 | 86.178 |
| 3-methylpentane | 63.25 | 231.4 | 452.4 | — | 0.664 | 86.178 |
| Hexane | 68.80 | 234.4 | 436.5 | — | 0.660 | 86.178 |
| Methyl cyclopentane | 71.85 | 259.6 | 548.1 | — | 0.754 | 84.162 |
| Cyclohexane | 80.70 | 280.3 | 590.1 | — | 0.780 | 84.162 |
| 2-methyl hexane | 90.05 | 257.2 | 395.8 | — | 0.679 | 100.205 |
| 3-methyl hexane | 91.85 | 262.1 | 407.4 | — | 0.687 | 100.205 |
| Heptane | 98.50 | 267.2 | 397.3 | — | 0.684 | 100.205 |
| Methanol | 64.60 | 239.5 | 1173 | 263.0 | 0.790 | 32.042 |
| Ethanol | 78.30 | 240.8 | 890.3 | 204.0 | 0.789 | 46.069 |
| Propanol | 97.15 | 263.7 | 749.7 | — | 0.804 | 60.096 |
| Isopropanol | 82.25 | 235.2 | 690.2 | — | 0.786 | 60.096 |
| 2-butanone | 79.55 | 263.7 | 610.5 | — | 0.805 | 72.107 |
| tert-butyl alcohol | 82.35 | 233.1 | 575.7 | — | 0.787 | 74.123 |
| Carbon dioxide | Sublimes | 31.0 | 1070.1 | — | — | 44.010 |
| Nitrogen | −195.8 | −147 | 491.6 | — | — | 28.013 |
| Water | 100.0 | 374.2 | 3207.4 | 556.9 | 1.000 | 18.015 |
| Methylene Chloride | 39.85 | 236.9 | 913.5 | — | 1.317 | 84.933 |
| (HFC-125) | −48.50 | — | — | — | — | 120.00 |
| (HFC-134a) | −26.50 | 113.3 | 652.0 | 52.4 | 1.190 | — |
| (HFC-152a) | −24.70 | — | — | 78.7 | 0.970 | — |

The following Table lists the weight ratio (Wt. Ratio) and known normal atmospheric boiling point (Tbp) for a few selected azeotropes useful in the invention. It will be understood that this list in non-limiting and that other alcohol/co-solvent azeotropes are useful in the invention.

| | Azeotropes | | |
|---|---|---|---|
| Co-solvent Spin Liquid | Alcohol Spin Liquid | Wt. Ratio | Tbp (C.) |
| n-heptane* | Methanol | 48.5/51.5 | 59.1 |
| n-heptane* | 2-propanol | 49.5/50.5 | 76.4 |
| Methyl cyclohexane* | Methanol | 46/54 | 59.2 |
| Methyl cyclohexane* | 2-propanol | 47/53 | 77.6 |
| Water** | 2-propanol | 12.2/87.8 | 79.5 |
| Water** | 1-propanol | 28.3/71.7 | 87.7 |

-continued

| | Azeotropes | | |
|---|---|---|---|
| Co-solvent Spin Liquid | Alcohol Spin Liquid | Wt. Ratio | Tbp (C.) |
| Water*** | Ethanol | 4/96 | 78.2 |

*Taken from "Physical and Azeotropic Data" by G. Claxton, National Benzole and Allied Products Association (N.B.A.), 1958.
**Taken from Industrial Solvents Handbook, 3rd Edition, Ed. E. W. Flick, Noyes Data Corporation (1985).
***Taken from CRC Handbook of Chemistry and Physics, 72nd Edition, Ed. D. R. Lide, CRC (1991).

In forming a spin mixture of fiber-forming polyolefin in the $C_{1-4}$ alcohol or $C_{1-4}$ alcohol/co-solvent spin liquids of the invention, a mixture of the fiber-forming polyolefin and spin liquid is raised to a mixing/spinning temperature in the range of 130 to 300 C. Mixing pressures less than the cloud-point pressure can be used as long as good mechanical mixing is provided to maintain a fine two phase dispersion (e.g., spin liquid-rich phase dispersed in polyolefin-rich phase). The mixtures described above are held under the required mixing pressure until a solution or a fine dispersion of the fiber-forming polyolefin is formed in the spin liquid. Usually, maximum pressures of less than 10,000 psig are satisfactory. After the fiber-forming polyolefin has dissolved, the pressure may be reduced somewhat and the spin mixture is then flash-spun to form the desired well fibrillated, plexifilamentary film-fibril strand structure.

It has been determined that for polypropylene and polymethylpentene that the mixing and spinning pressures should typically be greater than about 500 psig. It has also been determined for polyethylene that the mixing and spinning pressures should typically be greater than about 1,000 psig.

The concentration of fiber-forming polyolefin in the $C_{1-4}$ alcohol or $C_{1-4}$ alcohol/co-solvent spin liquid usually is in the range of 1–35 percent of the total weight of the spin liquid and the fiber-forming polyolefin. Higher polyolefin concentrations can be used (i.e., 30–35 wt. %) than are possible with hydrocarbon spin liquids (halogenated or non-halogenated) because of the alcohol's higher heat of vaporization and quenching power.

Conventional polyolefin or polymer additives can be incorporated into the spin mixtures by known techniques. These additives can function as ultraviolet-light stabilizers, antioxidants, fillers, dyes, and the like.

The various characteristics and properties mentioned in the preceding discussion and in the Tables and Examples which follow were determined by the following procedures:

Test Methods

Fibrillation level (FIB LEVEL) or quality of the plexifilamentary film-fibril strands produced in the Examples was rated subjectively. A rating of "5" indicates that the strand had better fibrillation than is usually achieved in the commercial production of spunbonded sheet made from flash-spun polyethylene strands. A rating of "4" indicates that the strand was as good as commercially flash-spun strands. A rating of "3" indicates that the strands were not quite as good as commercially flash-spun strands. A "2" rating indicates a very poorly fibrillated, inadequate strand. A "1" rating indicates no strand formation. A rating of "3" is the minimum considered satisfactory for use in the process of the present invention. The commercial strand product is produced from solutions of about 12.5% linear polyethylene in trichlorofluoromethane substantially as set forth in U.S. Pat. No. 4,554,207 (Lee), column 4, line 63, through column 5, line 10, which disclosure is hereby incorporated by reference.

Surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem Soc., V. 60 p 309–319 (1938) and is reported as $m^2/gm$.

Tenacity of the flash-spun strand is determined with an Instron tensile-testing machine. The strands are conditioned and tested at 70 F. and 65% relative humidity. The sample is then twisted to 10 turns per inch and mounted in the jaws of the Instron Tester. A 1-inch gauge length and an elongation rate of 60% per minute are used. The tenacity (T) at break is recorded in grams per denier (GPD).

Denier (DEN) of the strand is determined from the weight of a 15 cm sample length of strand.

Elongation (E%) of the flash-spun strand is measured as elongation at break and is reported as a percentage.

The invention is illustrated in the non-limiting Examples which follow with a batch process in equipment of relatively small size. Such batch processes can be scaled-up and converted to continuous flash-spinning processes that can be performed, for example, in the type of equipment disclosed by Anderson and Romano, U.S. Pat. No. 3,227,794. Parts and percentages are by weight unless otherwise indicated.

EXAMPLES

Description of Apparatus and Operating Procedures

The apparatus used in the following Examples consists of two high pressure cylindrical chambers, each equipped with a piston which is adapted to apply pressure to the contents of the vessel. The cylinders have an inside diameter of 1.0 inch ($2.54\times10^{-2}$ m) and each has an internal capacity of 50 cubic centimeters. The cylinders are connected to each other at one end through a 3/32 inch ($2.3\times10^{-3}$ m) diameter channel and a mixing chamber containing a series of open mesh screens used as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch ($6.3\times10^{-3}$ m) diameter and about 2.0 inch ($5.08\times10^{-2}$ m) length, and a spinneret orifice of 0.030 inch ($7.62\times10^{-4}$ m) diameter and 0.030 inches length. The pistons are driven by high pressure water supplied by a hydraulic system.

In operation, the apparatus is charged with polyethylene or polypropylene pellets and spin liquids. High pressure water (e.g. 1800 psi (12410 kPa)) is introduced to drive the piston to compress the charge. The contents then are heated to mixing temperature and when the desired temperature is reached, pressure is increased to the final mixing pressure. The contents are held at the mixing temperature for about an hour or longer during which time a differential pressure of about 50 psi (345 kPa) or higher is alternatively established between the two cylinders to repeatedly force the contents through the mixing channel from one cylinder to the other to provide mixing and affect formation of a spin mixture. The pressure letdown chambers, as disclosed in Anderson et al., were not used in these spinning Examples. Instead, the accumulator pressure was set to that desired for spinning at the end of the mixing cycle to simulate the letdown chamber effect. Next, the valve between the spin cell and the accumulator is opened, and then the spinneret orifice is opened immediately thereafter in rapid succession. The resultant flash-spun product is collected in a stainless steel open mesh screen basket. Because of the relatively small amount of material and high pressure used, most of the spins in these Examples lasted only a fraction of a second (e.g., 0.1 to 0.5 seconds).

It usually takes about two to five seconds to open the spinneret orifice after opening the valve between the spin cell and the accumulator. When letdown chambers are used, the residence time in the chamber is usually 0.2 to 0.8 seconds. However, it has been determined that residence time does not have too much effect on fiber morphology and/or properties as long as it is greater than about 0.1 second but less than about 30 seconds. When the valve between the spin cell and the accumulator is opened, the pressure inside the spin cell drops immediately from the mixing pressure to the accumulator pressure. The spin cell pressure drops again when the spinneret orifice is opened because of the pressure drop in the line. The pressure is measured during spinning just before the spinneret with a pressure transducer using a computer and is entered as the spin pressure in the Examples. It is usually lower than the set accumulator pressure by about 100 to 500 psig. Therefore, the quality of the two phase dispersion in the spin cell depends on both the accumulator pressure and the spin pressure, and the time at those pressures. Sometimes the accumulator pressure is set at a pressure higher than the cloud point pressure. In this case, the quality of the two phase dispersion in the spin cell will be determined primarily by the spin pressure reached after the spinneret orifice is opened.

The morphology of plexifilamentary strands obtained by this process is greatly influenced by the level of pressure used for spinning. When the spin pressure is much greater than the cloud-point pressure of the spin mixture, "yarn-like" strands are usually obtained. Conversely, as the spin pressure is gradually decreased, the average distance between the tie points becomes very short while the strands become progressively finer. When the spin pressure approaches the cloud-point pressure of the spin mixture, very fine strands are obtained, but the distance between the tie points become very short and the resultant product looks somewhat like a porous membrane. As the spin pressure is further reduced below the cloud-point pressure, the distance between the tie points starts to become longer. Well fibrillated plexifilaments, which are most suitable for sheet formation, are usually obtained when spin pressures slightly below the cloud point pressure are used. The use of pressures which are too much lower than the cloud-point pressure of the spin mixture generally leads to a relatively coarse plexifilamentary structure. The effect of spin pressure on fiber morphology also depends somewhat on the type of the polymer/spin liquid system to be spun. In some cases, well fibrillated plexifilaments can be obtained even at spin pressures slightly higher than the cloud-point pressure of the spin mixture. Therefore, the effect of spin pressure discussed herein is intended merely as a guide in selecting the initial spinning conditions to be used and not as a general rule.

For cloud-point pressure determination, the spinneret assembly is replaced with a view cell assembly containing a ½ inch ($1.23\times10^{-2}$ m) diameter high pressure sight glass, through which the contents of the cell can be viewed as they flow through the channel. The window was lighted by means of a fiber optic light guide, while the content at the window itself was displayed on a television screen through a closed circuit television camera. A pressure measuring device and a temperature measuring device located in close proximity to the window provided the pressure and temperature details of the content at the window respectively. The temperature and pressure of the contents at the window were continuously monitored by a computer. When a clear, homogeneous polymer-spin liquid mixture was established after a period of mixing, the temperature was held constant, and the differential pressure applied to the pistons was reduced to 0 psi (0 kPa), so that the pistons stopped moving. Then the pressure applied to the contents was gradually decreased until a second phase formed in the contents at the window. This second phase can be observed through the window in the form of cloudiness of the once clear, homogeneous polymer-spin liquid mixture. At the inception of this cloudiness in the content, the pressure and temperature as measured by the respective measuring devices near the window were recorded by the computer. This pressure is the phase separation pressure or the cloud-point pressure at that temperature for that polymer-spin liquid mixture. Once these data are recorded, mixing was again resumed, while the content was heated to the temperature where the next phase separation pressure has to be measured. As noted above, cloud-point pressures for selected polyolefin/spin liquid spin mixtures are plotted in FIGS. 1–6 at varying co-solvent spin liquid concentrations and spin temperatures.

The following Tables set forth the particular parameters tested and the samples used:

Table 1: High density polyethylene spun from 100% alcohol (e.g., 1-propanol and 2-propanol).

Table 2: High density polyethylene spun from an alcohol (e.g., ethanol) mixed with different co-solvent spin liquids (e.g., pentane and cyclohexane) to lower cloud-point pressure.

Table 3: High density polypropylene spun from 100% alcohol (e.g., ethanol and 2-propanol).

Table 4: High density polypropylene spun from a mixture of alcohols (e.g., ethanol mixed with 2-propanol).

Table 5: High density polypropylene spun from an alcohol (e.g., 1-propanol) mixed with a co-solvent spin liquid (e.g., water) to raise cloud-point pressure.

In the Tables, PE 7026A refers to a high density polyethylene (0.7 melt index) called Alathon 7026A commercially available from Occidental Chemical Corporation of Houston, Tex. PP 6823 refers to a high molecular weight polypropylene (0.4 melt flow rate) called Profax 6823 commercially available from Himont, Inc. of Wilmington, Del. PP 6523 refers to a high molecular weight polypropylene (4 melt flow rate) called Profax 6523 commercially available from Himont, Inc. of Wilmington, Del. CP350K refers to a medium molecular weight polypropylene (35 melt flow rate) commercially available from U.S. Steel of Pittsburgh, Pa.

In the Tables, MIX T stands for mixing temperature in degrees C, MIX P stands for mixing pressure in psig, SPIN T stands for spinning temperature in degrees C, ACCUM P stands for accumulator pressure in psig, SPIN P stands for spinning pressure in psig, T(GPD) stands for tenacity in grams per denier as measured at 1 inch ($2.54\times10^{-2}$ m) gauge length 10 turns per inch ($2.54\times10^{-2}$ m), E stands for elongation at break in %, and SA ($M^2/GM$) stands for surface area in square meters per gram. FIB LEVEL stands for the fibrillation level in descriptive terms. CONC stands for the weight percent of polyolefin based on the total amount of polyolefin and spin liquid present. SOLVENT stands for the alcohol spin liquid. CO-SOLVENT stands for the co-solvent spin liquid added and its weight percent based on the total amount of co-solvent spin liquid and alcohol spin liquid present.

All values in the Tables were obtained using a spinneret orifice having a length of 0.030 inches and a diameter of 0.030 inches.

TABLE 1-

| | POLYETHYLENE FIBERS SPUN FROM 100% ALCOHOLS | | | | |
|---|---|---|---|---|---|
| SAMPLE NO | 1 P11085-136 | 2-P11128-8 | 3 P11085-114 | 4 P11128-6 | 5 P11085-148 |
| POLYMER | PE 7026A | PE 7026A | PE 7026A | PE 7026A | PE 7026A |
| CONC (WGT %) | 20 | 22.5 | 22.5 | 22.5 | 22.5 |
| SOLVENT | 1-PROPANOL | 1-PROPANOL | 1-PROPANOL | 1-PROPANOL | 1-PROPANOL |

TABLE 1-continued

| | | | | | |
|---|---|---|---|---|---|
| CO-SOLVENT | NONE | NONE | NONE | NONE | NONE |
| MIX T (C.) | 250 | 250 | 250 | 250 | 250 |
| MIX P (PSIG) | ~5000 | 5000 | ~5000 | 5000 | ~5000 |
| SPIN T (C.) | 250 | 250 | 250 | 250 | 250 |
| ACCUM P (PSIG) | 4500 | 2750 | 3000 | 3250 | 3750 |
| SPIN P (PSIG) | 4050 | 2300 | 2500 | 2800 | — |
| DEN | 358 | 429 | 382 | 370 | 397 |
| T (GPD) | 3.1 | 3.25 | 3.35 | 3.86 | 3.79 |
| E (%) | 95 | 76 | 58 | 62 | 62 |
| FIB LEVEL | 4 | 4 | 4 | 4 | 4 |
| SA ($M^2$/GM) | | | | | |

| SAMPLE NO | 6 P11085-150 | 7 P11085-126 | 8 11085-106 |
|---|---|---|---|
| POLYMER | PE 7026A | PE 7026A | PE 7026A |
| CONC (WGT %) | 22.5 | 25 | 30 |
| SOLVENT | 1-PROPANOL | 1-PROPANOL | 2-PROPANOL |
| CO-SOLVENT | NONE | NONE | NONE |
| MIX T (C.) | 250 | 250 | 240 |
| MIX P (PSIG) | ~5000 | ~5000 | ~5000 |
| SPIN T (C.) | 250 | 250 | 240 |
| ACCUM P (PSIG) | 4250 | 2750 | ~5000 |
| SPIN P (PSIG) | 3650 | 2150 | 4200 |
| DEN | 449 | 479 | 871 |
| T (GPD) | 3.51 | 3.58 | 1.27 |
| E (%) | 73 | 103 | 61 |
| FIB LEVEL | 4 | 4 | 3.75 |
| SA ($M^2$/GM) | | | |

TABLE 2

POLYETHYLENE SPUN FROM VARIOUS ETHANOL BASED MIXED SPIN LIQUIDS

| SAMPLE NO | 1 P11030-52 | 2 P11087-20 | 3 P11087-21 | 4 P11087-22 |
|---|---|---|---|---|
| POLYMER | PE 7026A | PE 7026A | PE 7026A | PE 7026A |
| CONC (WGT %) | 22 | 22 | 22 | 22 |
| SOLVENT | 50% ETHANOL | 60% ETHANOL | 60% ETHANOL | 60% ETHANOL |
| CO-SOLVENT | 50% PENTANE | 40% CYCLOHEXANE | 40% CYCLOHEXANE | 40% CYCLOHEXANE |
| MIX T (C.) | 210 | 240 | 240 | 240 |
| MIX P (PSIG) | 5500 | 3250 | 3100 | 3300 |
| SPIN T (C.) | 210 | 240 | 240 | 240 |
| ACCUM P (PSIG) | — | 1800 | 1600 | 1400 |
| SPIN P (PSIG) | 2000 | 1625 | 1420 | 1280 |
| DEN | 321 | 223 | 242 | 206 |
| T (GPD) | 2.99 | 2.77 | 4.92 | 3.84 |
| E (%) | 97 | 118 | 84 | 91 |
| FIB LEVEL | 3.75 | 4 | 4 | 4 |
| SA ($M^2$/GM) | | | | |

TABLE 3

POLYPROPLENE SPUN FROM 100% ALCOHOLS

| SAMPLE NO | 1 P11169-56 | 2 P11169-34 | 3 P11169-64 | 4 P11169-48 | 5 P11128-78 | 6 P11169-86 | 7 P11169-146 |
|---|---|---|---|---|---|---|---|
| POLYMER | PP 6823 | PP 6823 | PP 6823 | PP 6823 | PP 6823 | PP 6823 | PP 6823 |
| CONC (WGT %) | 14 | 14 | 18 | 18 | 22 | 22 | 26 |
| SOLVENT | ETHANOL | ETHANOL | ETHANOL | ETHANOL | ETHANOL | ETHANOL | ETHANOL |
| CO-SOLVENT | NONE | NONE | NONE | NONE | NONE | NONE | NONE |
| MIX T (C.) | 260 | 260 | 280 | 260 | 250 | 280 | 240 |
| MIX P (PSIG) | 4000 | 4000 | 4000 | 4000 | 3500 | 4000 | 4000 |
| SPIN T (C.) | 260 | 260 | 280 | 260 | 250 | 280 | 240 |
| ACCUM P (PSIG) | 2700 | 2800 | 2600 | 2700 | 2400 | 2600 | 2500 |
| SPIN P (PSIG) | 2500 | 2550 | 2400 | 2450 | 1900 | 2350 | 2200 |
| DEN | 290 | 246 | 282 | 342 | 364 | 331 | 665 |
| T (GPD) | 1.47 | 1.84 | 2.12 | 2.25 | 2.19 | 2.05 | 1.52 |
| E (%) | 77 | 77 | 66 | 63 | 68 | 69 | 61 |
| FIB LEVEL | 4 | 4 | 4 | 4 | 4 | 4 | 4 |
| SA ($M^2$/GM) | 16 | 19 | — | | | | |

| SAMPLE NO | 8 11169-138 | 9 P11212-16 | 10 P11188-42 | 11 P11212-10 | 12 P11128-136 |
|---|---|---|---|---|---|
| POLYMER | PP 6823 | PP 6523 | PP 6523 | CP350K | PP 6823 |
| CONC (WGT %) | 30 | 18 | 22 | 18 | 22 |
| SOLVENT | ETHANOL | ETHANOL | ETHANOL | ETHANOL | 2-PROPANOL |
| CO-SOLVENT | NONE | NONE | NONE | NONE | NONE |
| MIX T (C.) | 240 | 260 | 260 | 260 | 250 |
| MIX P (PSIG) | 4000 | 4000 | 4000 | 4000 | 3000 |
| SPIN T (C.) | 240 | 260 | 260 | 260 | 250 |
| ACCUM P (PSIG) | 2300 | 2700 | 2700 | 2700 | 1200 |
| SPIN P (PSIG) | 1900 | 2400 | 2450 | 2470 | 1100 |
| DEN | 759 | 405 | 360 | 424 | 311 |
| T (GPD) | 0.89 | 1.32 | 1.46 | 0.49 | 1.53 |
| E (%) | 64 | 74 | 58 | 77 | 72 |

TABLE 3-continued

| | | | | | |
|---|---|---|---|---|---|
| FIB LEVEL SA ($M^2$/GM) | 3.75 | 4 | 4 | 4 | 4 |

TABLE 4

| POLYPROPYLENE SPUN FROM A MIXTURE OF ALCOHOLS | |
|---|---|
| SAMPLE NO | 1 P11169-18 |
| POLYMER | PP 6823 |
| CONC (WGT %) | 22 |
| SOLVENT | 50% ETHANOL |
| CO-SOLVENT | 50% 2-PROPANOL |
| MIX T (C.) | 250 |
| MIX P (PSIG) | 3000 |
| SPIN T (C.) | 250 |
| ACCUM P (PSIG) | 1500 |
| SPIN P (PSIG) | 1370 |
| DEN | 303 |
| T (GPD) | 2.12 |
| E (%) | 70 |
| FIB LEVEL SA ($M^2$/GM) | 4 |

TABLE 5

| POLYPROPYLENE SPUN FROM 1-PROPANOL AND WATER | | | | | |
|---|---|---|---|---|---|
| SAMPLE NO | 1 P11322-54 | 2 P11322-58 | 3 P11322-52 | 4 P11322-56 | 5 P11322-46 |
| POLYMER | PP 6523 | PP 6523 | PP 6523 | PP 6523 | PP 6523 |
| CONC (WGT %) | 12 | 14.5 | 17 | 19.5 | 22 |
| SOLVENT | 90% 1-PROPANOL | 90% 1-PROPANOL | 90% 1-PROPANOL | 90% 1-PROPANOL | 90% 1-PROPANOL |
| CO-SOLVENT | 10% WATER | 10% WATER | 10% WATER | 10% WATER | 10% WATER |
| MIX T (C.) | 260 | 260 | 260 | 260 | 260 |
| MIX P (PSIG) | 2500 | 2500 | 2500 | 2500 | 2500 |
| SPIN T (C.) | 260 | 260 | 260 | 260 | 260 |
| ACCUM P (PSIG) | 1100 | 1100 | 1100 | 1100 | 1100 |
| SPIN P (PSIG) | 1050 | 1030 | 1020 | 1020 | 1060 |
| DEN | 238 | 205 | 220 | 226 | 241 |
| T (GPD) | 0.79 | 1.55 | 1.44 | 1.56 | 0.91 |
| E (%) | 56 | 70 | 68 | 68 | 65 |
| FIB LEVEL SA ($M^2$/GM) | 4 | 4 | 4 | 4 | 4 |

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. A process for flash-spinning plexifilamentary film-fibril strands wherein a polyolefin is dissolved in a spin liquid to form a spin mixture containing 1 to 35 percent of polyolefin by weight of the spin mixture at a temperature in the range of 130 to 300 C. and a mixing pressure that is greater than the autogeneous pressure of the spin mixture, which spin mixture is flash-spun into a region of substantially lower temperature and pressure to form plexifilamentary film-fibril strands, the improvement comprising the spin liquid comprising an alcohol spin liquid containing from 1 to 4 carbon atoms and present in an amount no less than 50 percent by weight of the total spin liquid.

2. A process for flash-spinning plexifilamentary film-fibril strands wherein a polyolefin is dissolved in a spin liquid to form a spin mixture containing 1 to 35 percent of polyolefin by weight of the spin mixture at a temperature in the range of 130 to 300 C. and a mixing pressure that is greater than the autogeneous pressure of the spin mixture, which spin mixture is flash-spun into a region of substantially lower temperature and pressure to form plexifilamentary film-fibril strands, the improvement comprising the spin liquid comprising an alcohol/co-solvent spin liquid wherein the alcohol contains from 1 to 4 carbon atoms and the co-solvent is capable of raising the cloud-point pressure of the resulting spin mixture by at least 200 psig at the polyolefin concentration and the spin temperature used for flash-spinning, the co-solvent being a non-solvent for the polyolefin and present in an amount up to 50 percent by weight of the total alcohol/co-solvent spin liquid present.

3. The process of claim 2 wherein the co-solvent spin liquid is selected from the group consisting of inert gases, polar solvents, and mixtures thereof.

4. The process of claim 3 wherein the inert gas is selected from the group consisting of nitrogen and carbon dioxide.

5. The process of claim 3 wherein the polar solvent is selected from the group consisting of ketones and ethers.

6. The process as in any of claims 1 or 2–5 wherein the alcohol spin liquid is selected from the group consisting of methanol, ethanol, 1-propanol, 2-propanol, tertiary butanol and mixtures thereof.

7. The process as in any of claims 1 or 2–6 wherein the polyolefin is selected from the group consisting of polyethylene, polypropylene and polymethylpentene.

8. The process as in any of claims 1 or 2–7 wherein the mixing pressure is greater than the cloud-point pressure of the spin mixture.

9. A process for flash-spinning plexifilamentary film-fibril strands wherein polyethylene is dissolved in a spin liquid to form a spin mixture containing 1 to 35 percent polyethylene by weight of the spin mixture at a temperature in the range of 130 to 300 C. and a mixing pressure that is greater than the autogeneous pressure of the spin mixture, which spin mixture is flash-spun into a region of substantially lower temperature and pressure to form plexifilamentary film-fibril strands, the improvement comprising the spin liquid selected from the alcohol group consisting of 1-propanol, 2-propanol and mixtures thereof, wherein the selected alcohol is present in an amount no less than 50 percent by weight of the total spin liquid.

10. A process for flash-spinning plexifilamentary film-fibril strands wherein polypropylene is dissolved in a spin liquid to form a spin mixture containing 1 to 35 percent polypropylene by weight of the spin mixture at a temperature in the range of 130 to 300 C. and a mixing pressure that is greater than the autogeneous pressure of the spin mixture, which spin mixture is flash-spun into a region of substantially lower temperature and pressure to form plexifilamentary film-fibril strands, the improvement comprising the spin liquid being selected from the alcohol group consisting of ethanol, 1-propanol, 2-propanol and mixtures thereof, wherein the selected alcohol is present in an amount no less than 50 percent by weight of the total spin liquid.

11. The process of claim 3 wherein the polar solvent is water.

12. The process of claim 2 wherein the co-solvent is a perfluorinated hydrocarbon.

13. The process of claim 2 wherein the co-solvent is a hydrofluorocarbon.

14. The process of claim 2 wherein the co-solvent is a hydrochlorofluorocarbon.

* * * * *